US005184666A

United States Patent [19]

Gillon et al.

[11] Patent Number: 5,184,666

[45] Date of Patent: Feb. 9, 1993

[54] PROCESS AND DEVICE FOR CONTROLLING THE CONTINUOUS-CASTING THICKNESS OF A THIN STRIP OF ELECTRICALLY CONDUCTIVE MATERIAL

[75] Inventors: Pascale Gillon, Grenoble; Pascal Rivat, Haroué, both of France

[73] Assignees: Institut de Recherches de la Siderurgie Francaise-IRSID, Puteaux; Pechiney Recherche, Courbevoie, both of France

[21] Appl. No.: 720,707

[22] Filed: Jun. 25, 1991

[30] Foreign Application Priority Data

Jul. 16, 1990 [FR] France ..... 90 09708

[51] Int. Cl.[5] ..... B22D 27/02

[52] U.S. Cl. ..... 164/466; 164/429; 164/479; 164/502

[58] Field of Search ..... 164/502, 503, 466, 467, 164/463, 423, 429, 479

[56] References Cited

U.S. PATENT DOCUMENTS

| | | | |
|---|---|---|---|
| H892 | 3/1991 | Walk et al. | 164/502 |
| 4,751,957 | 6/1988 | Vaught | 164/423 |
| 4,807,694 | 2/1989 | Vives et al. | 164/466 |

*Primary Examiner*—Kuang Y. Lin

*Attorney, Agent, or Firm*—Dennison, Meserole, Pollack & Scheiner

[57] ABSTRACT

An electromagnetic process and apparatus for continuous casting of a thin strip of electrically conductive material on a cooled roll. The free surface of the material in the liquid state in the casting feed injector is subjected to the action of an alternating magnetic field generated by a single phase electrical current. The magnetic field can be generated by means of an inductor from tubular elements within which cooling water circulates.

11 Claims, 3 Drawing Sheets

PROCESS AND DEVICE FOR CONTROLLING THE CONTINUOUS-CASTING THICKNESS OF A THIN STRIP OF ELECTRICALLY CONDUCTIVE MATERIAL

The present invention relates to a process and a device for controlling the continuous-casting thickness of a thin strip formed by an electrically conductive material, such as particularly a metal or a metal alloy.

It is known to an average person skilled in the art of shaping materials that strip of a thickness in the neighbourhood of 1 mm can be obtained directly by bringing a molten material into contact with a cooled metal roll which rotates about a horizontal axis, this bringing into contact being obtained by means of an injector equipped with a U-shaped orifice which is elongate in parallel with the generatrix of the said roll, in such a way that the free surface of the material touches the surface of the roll and, during rotation, forms a meniscus.

Under these conditions, the liquid material solidifies in the form of a layer of small thickness which adheres slightly to the substrate consisting of the surface of the roll and which, by means of the meniscus, carries with it an additional fraction of liquid material so that a continuous strip is obtained.

The thickness of the strip produced in this way depends on the rotational speed of the roll, on the height of the molten material in the orifice of the injector and on the heat-transfer characteristics of the roll.

This direct continuous-casting process, also called "melt overflow", although simple in principle, nevertheless presents some difficulties in terms of industrial use, for example when strips of relatively large width are to be manufactured.

In fact, most often, the strip produced by this process has variations in thickness both in the longitudinal and in the transverse direction, thus making it difficult to use either directly or after undergoing mechanical and/or thermal treatments.

The fact that the thickness of the cast strip is not uniform longitudinally is attributable to two causes. The first derives from the fact that the process adopted involves a continuous outflow of material outwards from the machine, its quantity being determined by the machine itself and being neither known in advance nor uniform nor controlled.

This makes it necessary to introduce new material into the injector continuously, with the need to maintain its level at a constant height. Now on an industrial site, this introduction is not continuous because of the response time of the measuring and regulating systems. Consequently, there are disturbances which result, on the one hand, in a variation in the height of the material in the injector and, on the other hand, in the formation of waves on the surface, originating from the place where the liquid material is introduced into the injector.

The second cause is attributed to the rotation of the roll and to the extraction of the solidified strip, these likewise giving rise to disturbances of the free surface of the material, leading to the formation of waves in the region of the meniscus.

Where transverse defects are concerned, these can likewise be attributed to a plurality of causes, particularly:

a cause of thermal origin. Since the cooled roll is wider than the strip, the cooling of the molten material is greater at the edges than in the central part of the strip being cast. The heterogeneous cooling produces a strip of non-uniform cross-section;

a cause of interfacial origin. Since the free surface of the liquid material cannot be perpendicular to the wall of the injector, the edge of the strip is either overfed or underfed with liquid, thus resulting in a non-uniform thickness.

Consequently, any variation in the level of the liquid in time or space will give rise to defects in the morphology of the strip and particularly in its thickness, a disturbance in time leading rather to longitudinal defects and a disturbance in space to transverse defects.

To obtain a strip of controlled thickness, therefore, two conditions will have to be satisfied:

stabilising the free surface of the material in the orifice of the injector;

maintaining the said surface in a specific constant position

From this stems the search for solutions aimed at obtaining these conditions and the employment by various inventors of means making it possible to control the thickness and profile of the strip produced.

But these means, which have been the subject of patent applications, do not seem at the moment to have provided a real solution to the problem presented.

Mention may be made, for example, of:

the European application published under no. 174,765 and filed with the priority of 1984, in which, to obtain a uniform flow of material over the entire width of the orifice of the injector, dams 36 partially submerged in the bath of material which the injector contains are used.

U S. Pat. No. 4,771,819 filed with the priority of 1985, which teaches the introduction of a cooled rotary roller of small diameter which is partially immersed in the upper part of the bath of liquid material and of which the spacing from the casting roll serves for determining the thickness of the strip.

patent application WO 87/02285 filed with the priority of 1988, which proposes the use of an air jet over the entire length of the generatrix of the roll, to eliminate the undulations of the surface of the material in the region of the orifice of the injector. The effectiveness of this system assumes a stability of the gas pressure for preventing other disturbances of the surface.

patent application WO 89/07025 filed with the priority of 1988 likewise describes the use of a roller, but one which, here, is heated to a temperature higher than the melting temperature of the cast material, the control of the thickness also being obtained by the spacing between the roll and the roller which lets pass only a layer of liquid constant in time and uniform in space.

U.S. Pat. No. 4,842,042 filed with the priority of 1988, in which there is also used a roller which is of an axis parallel to that of the cooled roll, but which demands means for setting a given space between these two elements independently of the surface irregularities of the roll.

All these means therefore involve introducing into the bath of material foreign bodies, such as a dam and a roller or a gas stream, which constitute many sources of pollution of the product obtained.

Moreover, such systems can bring about hydrodynamic and thermal disturbances in the bath.

Furthermore, if an accessory roll is used, structural problems can arise, particularly at the junction between the already solidified part and the liquid part circulating under the roller, this being a disadvantage to which can be added the occurrence of tension and stress phenomena in the strip, especially when there is a speed difference between the roll and the roller.

Finally, the layers of material deposited on these two surfaces meet one another in different directions, and this can impair the homogeneity of the strip produced.

Consequently, the applicant, wishing to solve the problem of the control of the continuous-casting thickness of a thin strip of electrically conducting material by the technique of melt overflow and aware of the disadvantages which the means of the prior art still have, looked for and found an original solution utilising electromagnetic forces and requiring no contact of the material with a foreign element.

This gave rise to the invention consisting of a process for controlling the continuous-casting thickness of a thin strip of electrically conductive material obtained by bringing the said material into contact in the liquid state with the cooled lateral wall of a rotating roll on which it solidifies, the said material being supplied by means of an injector, the end of which opens along the generatrix of the roll, in such a way that its free surface touches the said wall, characterised in that the surface of the material placed in the injector is subjected to the action of an alternating magnetic field generated by a single-phase electrical current.

This field, preferably applied in the vicinity of the rotating roll and near the surface of the liquid, is essentially localised to a limited depth of material, called the electromagnetic skin thickness "δ", where two main effects occur:

it exerts on the surface of the liquid an electromagnetic pressure proportional to $B^2/4\mu$ where B is the induction modulus and $\mu$ the magnetic permeability;

it has a stabilising capacity on the possible undulations of the said surface.

Its action is comparable to that of a means which, as a function of the electromagnetic characteristics, such as the intensity and frequency of the current, the distribution in space of the magnetic field along the surface of the material and the roll, positions and imposes a constant shape on the meniscus of liquid material in contact with the generatrix of the roll, whilst at the same time removing possible undulations from the surface of the material in order to give it a smooth appearance.

There is thus an original means which makes it possible to control the height of liquid material in the injector near the roll and to stabilise its free surface in respect of possible disturbances and, finally, to govern the thickness of the cast strip.

As well as the pressure exerted on the surface of the material, the alternating magnetic field has two additional actions:

it generates a mixing effect in the bath of material placed in the injector, it dissipates a certain amount of heat in the skin thickness by the Joule effect.

The relative importance of these three effects is evaluated by means of the screen parameter Rω defined according to the relation: $R\omega = \mu 94\ \omega L^2$ where $\sigma$ is the electrical conductivity, ω the pulsation of the magnetic field and L the height of liquid in the injector.

The screen parameter Rω (or a dimensional frequency) is linked to the value of the skin thickness δ by the relation: $R\omega = 2(L/\delta)^2$.

Optimum mixing is obtained for a value of Rω near to 40 and optimum heating for a value near 20.

The stabilisation and control of the shape of the surface are obtained for a value of Rω higher than 200.

Such a process has the following accessory advantages:

it prevents any contact of the metal with a foreign material and therefore any risk of pollution and/or any structural defect associated with solidification on a foreign body.

it makes it possible to cast products of very small thickness because of the possibility of a very fine adjustment of the action of the field and the absence of any mechanical means.

the effect of mixing the volume of liquid material results in a homogenisation of its temperature.

the twinning of the pressure and mixing effects leads to a smoothing of the quantity of liquid material carried along by the moving solid strip, thus resulting in a beneficial effect on the quality of the strip produced.

This process applies to any electrically conductive material and particularly to ferrous or nonferrous metals and their alloys.

The invention also relates to a device for carrying out the process according to the invention.

This device consists of a circuit comprising a single-phase alternating-current generator, at least one capacitor and at least one inductor, characterised in that the said inductor is formed from at least one cooled hollow metallic element placed above the surface of the liquid material contained in the injector and elongate in parallel with the generatrix of the roll and over at least its entire length.

Thus, the device according to the invention consists of a circuit, in which a generator generating a single-phase alternating current, at least one capacitor and one inductor are connected electrically so as to form an oscillating circuit. For a given inductor, the frequency is fixed by the choice of the capacitance of the capacitor or capacitors. This frequency is determined as a function of the sought-after effects: pressure, mixing and heating.

The inductor is formed from at least one cooled hollow element, such as, for example, a copper tube within which cooling water circulates. The inside diameter of this tube is selected so that the temperature of the water does not exceed 70° C., whatever the Joule effect occurring as a result of the passage of the current. The thickness of the tube is greater than the electromagnetic skin thickness, that is to say the thickness over which the current is distributed in the tube.

This inductor is placed above the surface of the liquid metal contained in the injector and in parallel with the generatrix of the roll and at a short distance, that is to say, for example, at less than 1 cm, so that the magnetic field generated by the inductor is exerted with maximum efficiency according to the desired shape and the desired elimination of the undulations.

To reduce the electromagnetic end effects, the inductor preferably has a length greater than the width of the orifice of the injector.

The inductor is formed either from one or from a plurality of elements connected to one another. In the latter case, the said elements can be arranged either in the same plane or in different planes, at least one of which is located above the surface of the liquid material placed in the injector; these planes are either parallel or oblique relative to the said surface, the inclination being selected as a function of the desired shape and the desired elimination of the undulations.

Outside the part which connects them and which can be of any shape, these elements either are rectilinear or have a curvature over their entire length or over a portion of the said length, this curvature being arranged in a plane parallel to the generatrix of the roll and directed upwards and/or downwards.

There can, for example, be elements comprising a rectilinear central portion and two curved ends. These special shapes make it possible either to correct the edge effects or to give the strip a particular profile.

Various configurations are employed, making it possible to act on the value of the inductance and/or intensity of the magnetic field, whilst the geometrical characteristics are selected as a function of the permitted overall size and the desired effect.

The invention will be better understood with the aid of the accompanying Figures, of which:

Figure 1:
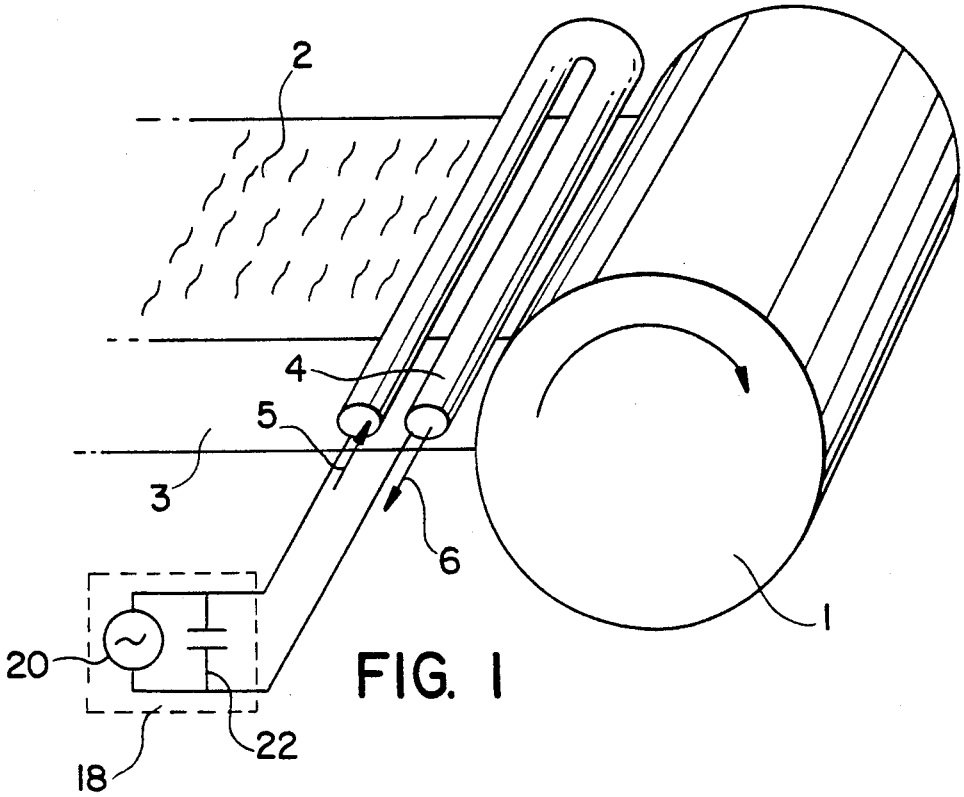
FIG. 1 shows a perspective view of a casting machine equipped with an inductor having two elements.

FIG. 1 shows in more detail a casting roll 1, the free surface 2 of a bath of liquid metal contained in an injector 3 and an inductor 4 formed from two tubular elements which are joined together in the form of a U and within which water circulates in the direction of the arrows 5 and 6.

FIG. 1 also shows schematically an oscillating current generator 18 formed from a single phase alternating current generator 20 connected in parallel with a capacitor 22, the oscillating current generator 18 being connected to inductor 4.

Figure 2:
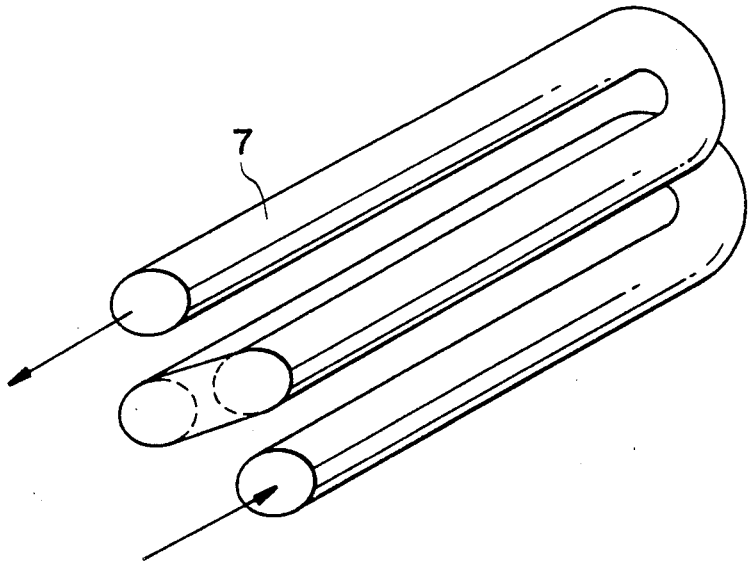
FIG. 2 shows a perspective view of an inductor with four elements.

FIG. 2 shows an inductor formed from four elements 7 joined together in the form of two Us connected to one another and arranged in two different planes.

Figure 3:
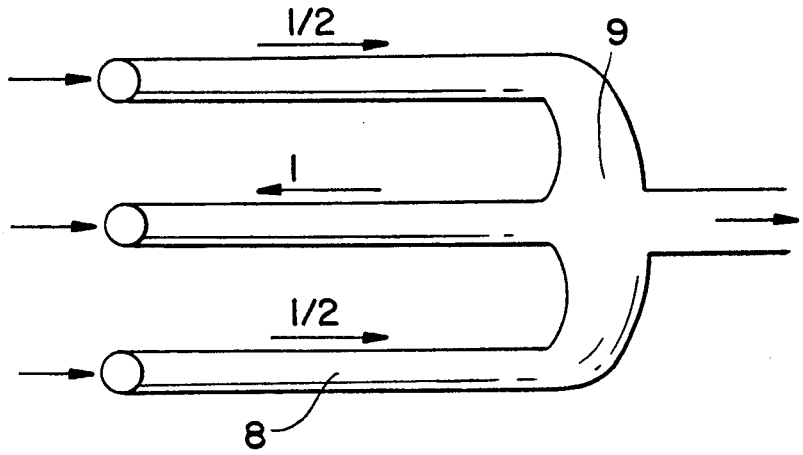
FIG. 3 shows a top view of an inductor with three elements arranged in the same plane.

In FIG. 3, the inductor is composed of three elements 8 which are parallel to one another, arranged in the same plane and connected to one another at a point 9.

Figure 4:
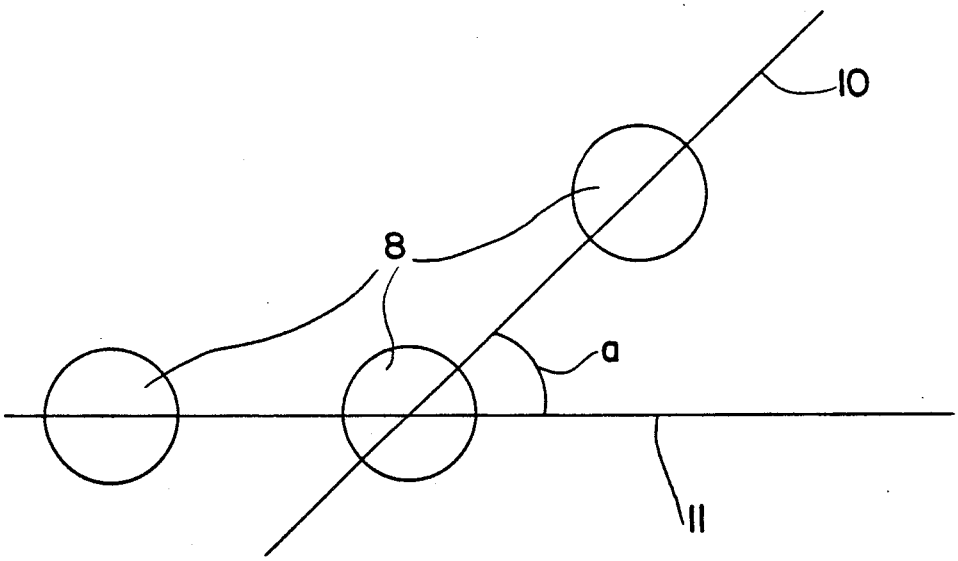
FIG. 4 shows a view in vertical section of an inductor with three elements arranged in two different planes.

It can be seen from FIG. 4 that the three elements 8 are arranged in two planes 10 and 11 forming between them an angle a in the neighbourhood of 45 degrees.

Figure 5:
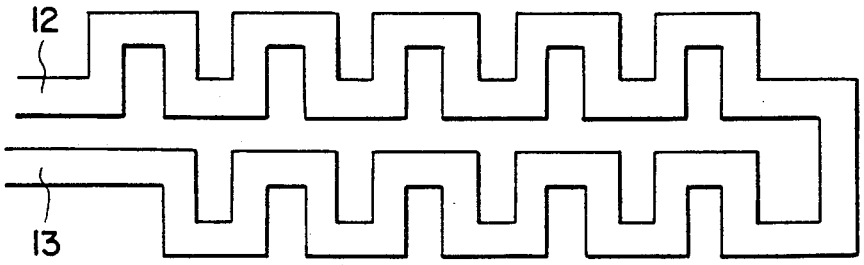
FIG. 5 shows a top view of an inductor with two elements in the form of a broken line.

FIG. 5 shows the two elements 12 and 13, each formed by a succession of straight segments connected at right angles.

Figure 6:
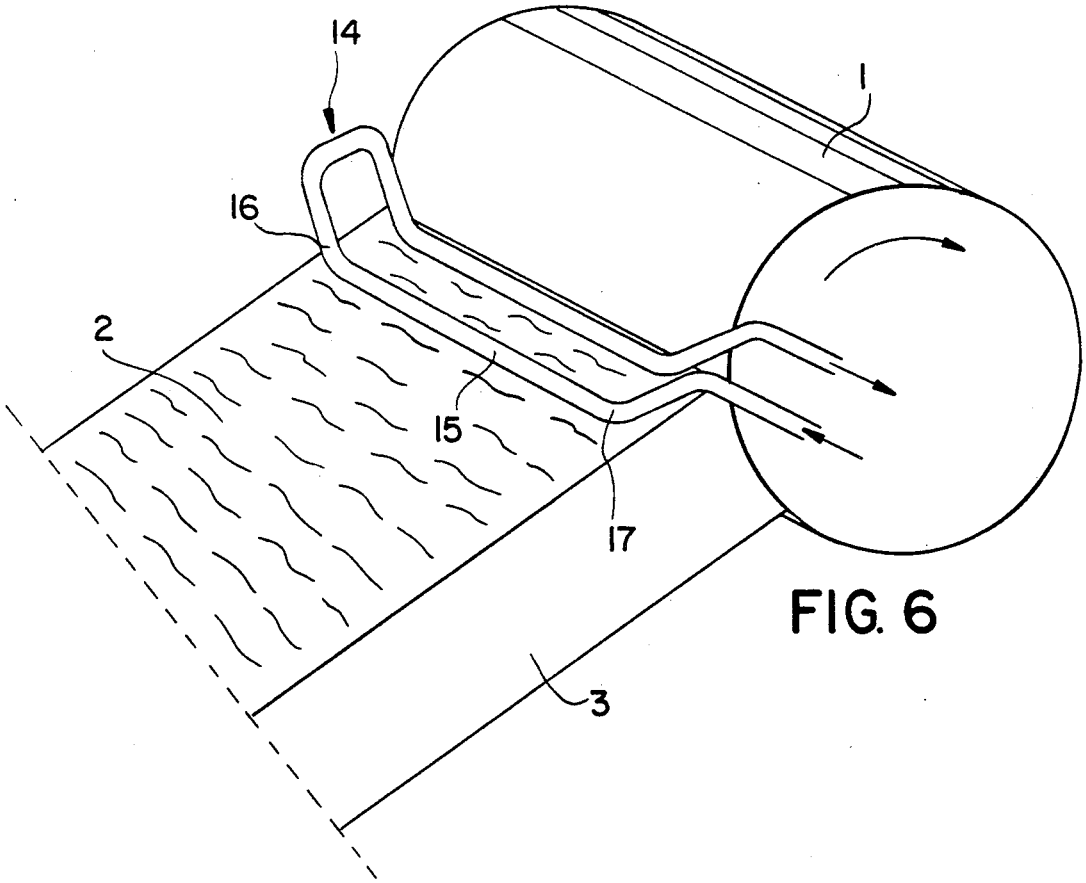
FIG. 6 shows a perspective view of a casting machine equipped with an inductor having two elements, of which the central portion is rectilinear and the ends curved.

FIG. 6 shows an inductor 14 formed from two elements, each possessing a rectilinear portion 15 and two curves 16 and 17 turned upwards; this inductor is arranged in parallel with the generatrix of the roll 1 above the free surface 2 of a bath of liquid metal contained in an injector 3.

The invention can be illustrated by means of the following practical examples:

EXAMPLE 1

An inductor of the configuration of FIG. 1 was constructed from a copper tube of outside diameter 6 mm and inside diameter 4 mm. These elements, the distance between whose axes is 9 mm, are placed at a distance of 5 mm above the surface of a bath of aluminium alloy and in parallel with the axis of the roll, the nearest element having its axis located at a distance of 4.5 mm from the surface of the roll along a radius. As soon as a single-phase electrical current of an intensity of 250 A and a frequency of 170 kHz was passed through the inductor, the free surface of the metal exhibited, during the casting, a depression of a maximum amount of 6 mm, that is to say a reduction in the height of liquid of 3.5 mm at the meniscus, and was free of any disturbance.

EXAMPLE 2

The same inductor was used under the same conditions for casting an austenitic stainless steel containing by weight: 18% of chromium, 10% of nickel and <0.08% of carbon. Under these conditions, a reduction in the height of liquid of 2.5 mm at the meniscus was observed, and the surface was free of any disturbance.

EXAMPLE 3

An inductor identical to that of Example 1 is positioned in a plane inclined at 40 degrees relative to the horizontal plane and placed above the surface of liquid metal consisting of an aluminium alloy and contained in the injector of a casting machine, in such a way that the axis of the lower element is 4 mm from the surface of the roll and that of the higher element is 4.5 mm from the surface.

When a single-phase current of a frequency of 80 kHz and an intensity of 250 A was passed through this inductor, the presence of a depression of an amount of 6 mm on the surface of the metal and the absence of any disturbance were likewise established.

EXAMPLE 4

An inductor of a configuration similar to that of FIG. 4, produced from a copper tube of the same dimensions as that of Example 1, was used.

The plane 11 was placed parallel to the surface of liquid metal consisting of an aluminium alloy and contained in the injector of a casting machine and at a distance of 5 mm, whilst the axis of the element arranged the higher in the plane 10 was located 4.5 mm from the surface of the roll.

With such a device, when a single-phase current of an intensity of 250 A was passed through the central element, the current flux lines looped round in the outer elements at an intensity of 125 A.

Under these operating conditions and by the use of a frequency of 170 kHz, it was found that the surface of the metal in the injector exhibited a much more extensive deformation of an amount at the centre of 7.6 mm; the height of the liquid at the meniscus was thus controlled with greater accuracy, since it was located at the centre of the deformation.

We claim:

1. Process for continuous casting of a thin strip of electrically conductive material comprising:

supplying said material in the liquid state having a height L, a magnetic permeability $\mu$ and electrical conductivity $\sigma$ by means of an injector to a cooled lateral wall of a rotating roll on which said material solidifies to form a thin strip, an end of said injector opening along the generatrix of the roll such that free surface of said material touches said wall, and controlling tne thickness of said thin strip by subjecting the surface of said material in said injector of said height L to the action of an alternating magnetic field of pulsation w generated by a single phase electric current.

2. Process according to claim 1, wherein the magnetic field is applied in the vicinity of the roll and near the surface of the liquid.

3. Process according to claim 1, wherein the distance separating the point of application of the field from the surface of the material placed in the injector is adjustable.

4. Process according to claim 1, wherein the magnetic field has a frequency such that the screen parameter $Rw=\mu.\sigma.w.L^2$ has a value higher than 200.

5. Process according to claim 1, wherein the material is a nonferrous metal or alloy thereof.

6. Process according to claim 1, wherein the material is a ferrous metal or alloy thereof.

7. Apparatus for continuous casting of a thin strip of electrically conductive material, comprising:

a cooled rotating roll;

an injector for carrying the material in molten form with a height L, said injector having an end which opens along the generatrix of said roll; and an electrical circuit comprising a single phase alternating current generator, at least one capacitor, and at least one inductor electrically connected so as to produce an oscillating current, said inductor comprising at least one cooled hollow metallic element placed above said injector and elongated in a direction parallel to the generatrix of the roll, and over at least the entire length of the roll.

8. Apparatus according to claim 7, wherein when the inductor is formed from a plurality of parallel elements.

9. Apparatus according to claim 7, wherein the elements are rectilinear.

10. Apparatus according to claim 7, wherein at least one of the elements has at least a curvature over at least a portion of its length, the curvature being arranged in a plane parallel to the generatrix of the roll and directed upwards and/or downwards.

11. Apparatus according to claim 7, additionally comprising a source of cooling fluid connected to said element.

* * * * *